US005964316A

United States Patent [19]

Roy

[11] Patent Number: 5,964,316

[45] **Date of Patent: *Oct. 12, 1999**

[54] FALL PREVENTION SYSTEM FOR TOP MOUNT ANTENNA

[76] Inventor: Gilles Roy, 175, P.R. Lamarche, Laprairie, Canada, J5R 5M3

[ * ] Notice: This patent issued on a continued prosecution application filed under 37 CFR 1.53(d), and is subject to the twenty year patent term provisions of 35 U.S.C. 154(a)(2).

[21] Appl. No.: 08/754,011

[22] Filed: Nov. 20, 1996

[51] Int. Cl.[6] ..... E06C 5/36

[52] U.S. Cl. ..... 182/3; 182/8

[58] Field of Search ..... 182/3, 8

[56] References Cited

U.S. PATENT DOCUMENTS

| | | | |
|---|---|---|---|
| 3,908,791 | 9/1975 | Kleine | 182/8 |
| 5,316,102 | 5/1994 | Bell | 182/3 |
| 5,417,303 | 5/1995 | Bell | 182/3 |

FOREIGN PATENT DOCUMENTS

| | | | |
|---|---|---|---|
| 1178866 | 9/1985 | U.S.S.R. | 182/3 |

OTHER PUBLICATIONS

Ladder Safety Systems RAILOK®, DBI/SALA® Pamphlet—one page.

The Fall Prevention System . . . and How it Works, Miller Pamphlet & Bulletin No. 100 C 4 pages.

Trylon Safety Rail Fall Protection System . . . Trylon Manufacturing Company Ltd. Pamphlet—2 pages.

Ladder Safety Systems Notched Rail, DBI/SALA® Pamphlet—one page.

Coulisseau de sécurité 2873, North—Pamphlet—one page.

Coulisseaux et Cordages à la Hauteur, Prévention au Travail, Août–Sep. 1996 pp. 40–41.

Phillistran® High Performance Tower Guy, HPTG–I, Technical Bulletin 2 pages.

Safety Cable Fall Protection, Hughey & Phillips, Inc.—Pamphlet 1 page.

*Primary Examiner*—Alvin Chin-Shue

*Attorney, Agent, or Firm*—Eric Fincham

[57] ABSTRACT

In a vertical radio-frequency wave radiating structure to be climbed by a person, there is provided a fall prevention system. This fall prevention system includes a safety rope, made of a radio-frequency wave resistant material, to receive an individual safety harness. A first end of the safety rope is attached to an upper section of the vertical structure, while the second end of that safety rope is attached to a lower section of the vertical structure. Preferably, the safety rope comprises a polyurethane resin impregnated aramid fiber core protected with a thick extruded jacket of polyurethane.

3 Claims, 5 Drawing Sheets

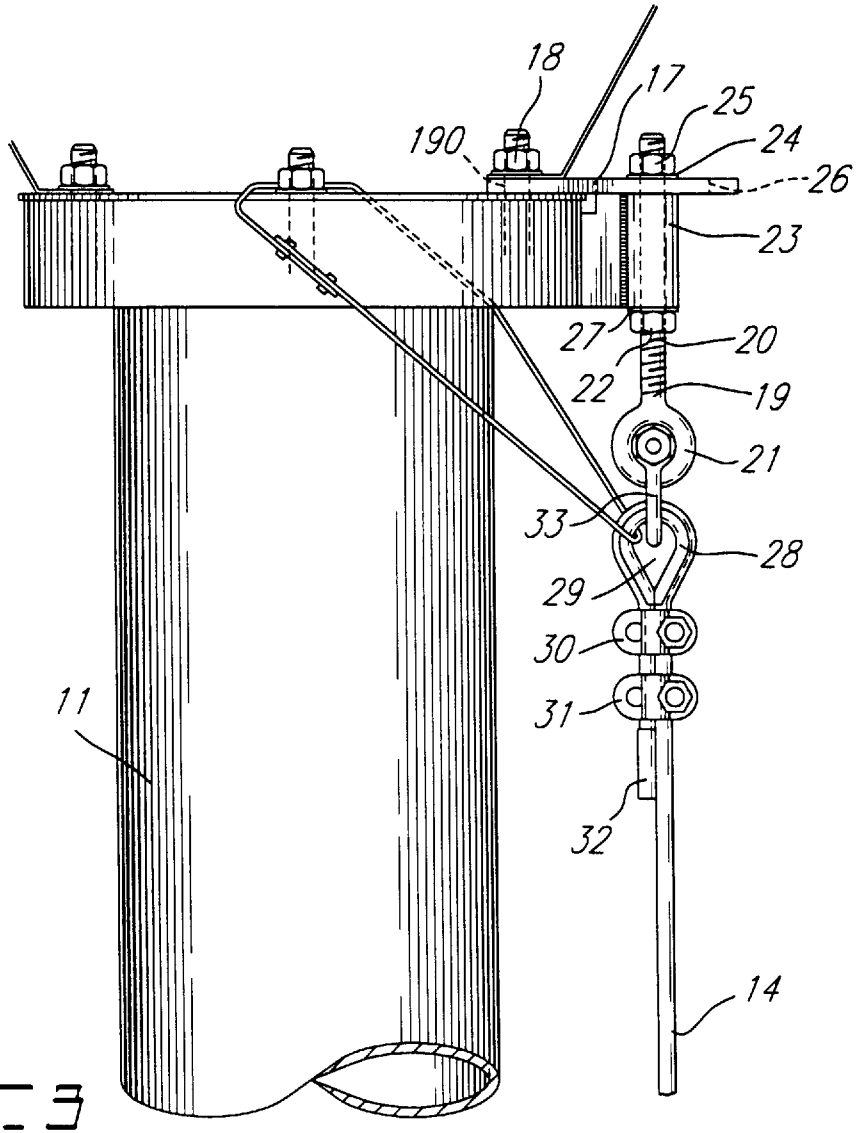
FIG. 3
FIG. 2
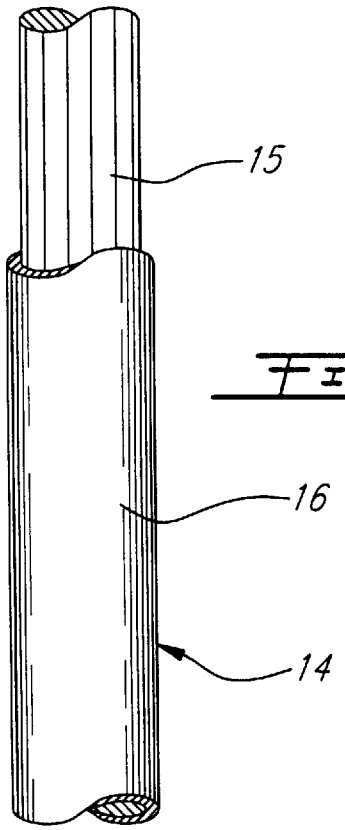

FALL PREVENTION SYSTEM FOR TOP MOUNT ANTENNA

BACKGROUND OF THE INVENTION

1. Field of the Invention

The present invention relates to a fall prevention system. More specifically, the present invention is concerned with a security system for preventing persons from falling when climbing a pylon, tower, mast or the like for maintenance or any other purpose.

2. Brief Description of the Prior Art

The prior art fall prevention systems presently in operation and presently available on the market are made of metal such as stainless steel or aluminum.

As well known to those of ordinary skill in the art, television broadcasting requires a vertical antenna 20–200 feet high mounted at the top of a tower 100–1500 feet high. These top mount antenna have a radiation pattern of 360° and radiates radio-frequency (RF) waves at powers as high as 10 kW–500 kW depending on the area to be covered.

As RF waves propagating through the air are reflected by pieces of metal, including stainless steel and aluminium, a prior art metallic fall prevention system installed onto a top mount antenna will reflect the RF waves and return these waves to the antenna to thereby cause a distortion of the radiation pattern and thereby greatly reduce the efficiency of the top mount antenna.

Accordingly, in 80% of the television broadcasting antenna installations presently in operation, a fall prevention system is provided on the tower between the ground and the top mount antenna. For the above reasons, metallic fall prevention systems have never been installed onto the top mount antenna.

Other types of ropes, made for example of nylon, polypropylene, etc., are also available on the market to construct fall prevention systems. Unfortunately, these ropes do not resist to ultraviolet (UV) rays and to RF radiation. They also allow water to infiltrate therein. As the top mount antennae radiate a high concentration of RF waves, such ropes would deteriorate very quickly to result into a non reliable and dangerous fall prevention system.

Another alternative is to install a temporary fall prevention system. The drawback of this alternative is that the worker will benefit no protection during installation and dismantlement such a temporary fall prevention system. Dismantlement is required since steel installations will reflect radio-frequency waves while nylon and polypropylene ropes will deteriorate by exposure to the RF radiation.

OBJECT OF THE INVENTION

An object of the present invention is therefore to overcome the above discussed drawbacks of the prior art by constructing a fall prevention system with a rope capable of resisting to UV rays and to high intensity RF radiation.

SUMMARY OF THE INVENTION

More specifically, in accordance with the present invention, there is provided a fall prevention system for installation along a generally vertical radio-frequency wave radiating structure to be climbed by a person between lower and upper sections thereof. The fall prevention system comprises a safety rope made of a radio-frequency wave resistant material, and mechanical means for installing the safety rope generally vertically along the generally vertical structure. The mechanical means comprises first means for attaching a first end of the safety rope to the upper section of the generally vertical structure, and second means for attaching the second end of the safety rope to the lower section of the generally vertical structure.

The fall prevention system may further comprise harness means slidable along the safety rope for attaching the person to the safety rope as the person climbs the generally vertical structure.

The present invention further relates to a generally vertical radio-frequency wave radiating structure to be climbed by a person between lower and upper sections thereof, the improvement therein comprising a fall prevention system including (a) a safety rope made of a radio-frequency wave resistant material, and (b) mechanical means for installing the safety rope generally vertically along the generally vertical structure. The mechanical means comprises first means for attaching a first end of the safety rope to the upper section of the generally vertical structure, and second means for attaching the second end of the safety rope to the lower section of that generally vertical structure.

In accordance with preferred embodiments:

- the safety rope comprises a polyurethane resin impregnated aramid fiber core protected with a thick extruded jacket of polyurethane;
- the second attaching means comprises spring means for tensioning the safety rope;
- the mechanical means further comprise at least one rope stand-off bracket intermediate the first and second attaching means, which rope stand-off bracket being mounted to the generally vertical structure and comprising means for removably grasping the safety rope.

The objects, advantages and other features of the present invention will become more apparent upon reading of the following non restrictive description of a preferred embodiment thereof, given by way of example only with reference to the accompanying drawings.

BRIEF DESCRIPTION OF THE DRAWINGS

In the appended drawings:

FIG. 2 is a side elevational, partially cut out, view of a safety rope forming part of the fall prevention system of FIG. 1;

FIG. 3 is a partial, enlarged side elevational view of the fall prevention system of FIG. 1, showing a mechanical assembly for attaching the upper end of the safety rope to the upper section of the top mount antenna;

DETAILED DESCRIPTION OF THE PREFERRED EMBODIMENT

Figure 1:
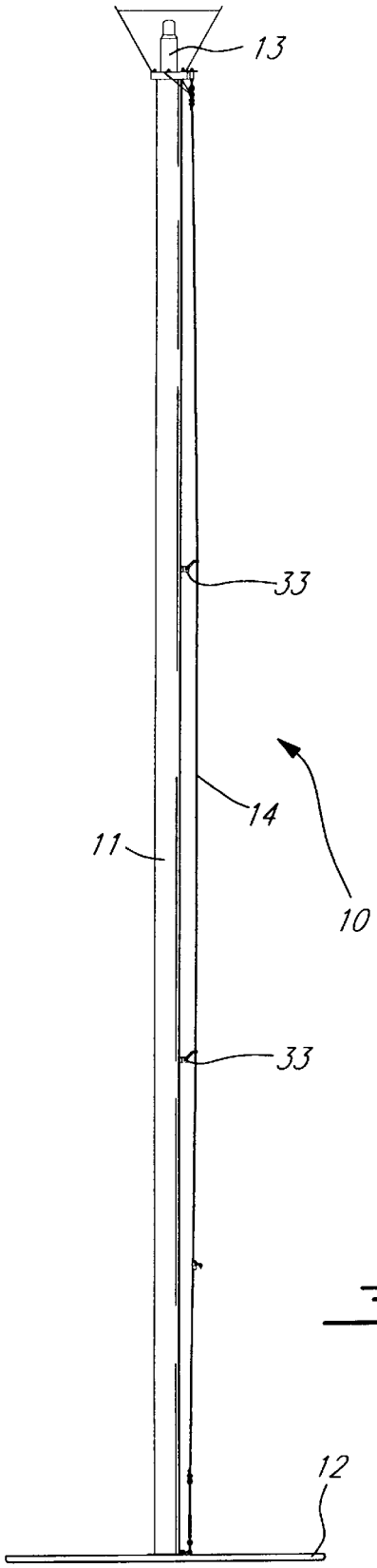
FIG. 1 is a side elevational view of a fall prevention system in accordance with the present invention, installed to a vertical top mount antenna.

Referring to FIG. 1 of the appended drawings, the fall prevention system, generally identified by the reference 10, is installed to a generally vertical top mount antenna 11, made of steel, of a high power television broadcasting tower 12. A high structure obstruction marking lamp 13 is mounted at the upper end of the top mount antenna 11.

The fall prevention system 10 comprises a safety rope 14 mounted generally vertical along the top mount antenna 11. The safety rope 14 is parallel to but spaced apart from the top mount antenna 11. Safety rope 14 is made of aramid fiber (Kevlar). More specifically, as illustrated in FIG. 2, the safety rope 14 is formed of a polyurethane resin impregnated aramid fiber core 15 protected with a thick extruded jacket 16 also made of polyurethane.

An aramid fiber rope offers high modulus, high strength and stretch properties comparable to steel strand, but at a fraction of the weight; aramid fiber presents a strength-to-weight ratio five times greater than steel plus low-stretch, low-creep characteristics.

A suitable safety rope 14 is the one commercialized under the trademark PHILLYSTRAN®, by the company Phillystran, Inc. Values for the minimum loads at which PHILLYSTRAN® aramid fiber ropes of different diameters will break are given in the following Table 1:

TABLE 1

| Jacketed diameter | | Jacketed weight | | Break strength (minimum weight) |
|---|---|---|---|---|
| in. | mm | lbs/1000 ft | kg/km | (lbs) |
| .19 | 4.8 | 13 | 19 | 1200 |
| .24 | 6.1 | 21 | 31 | 2100 |
| .30 | 7.6 | 33 | 49 | 4000 |
| .37 | 9.4 | 50 | 75 | 6700 |
| .44 | 11.2 | 70 | 104 | 11200 |
| .52 | 13.2 | 96 | 143 | 15400 |
| .61 | 15.5 | 125 | 186 | 26800 |
| .69 | 17.5 | 160 | 238 | 27000 |
| .75 | 19.1 | 185 | 276 | 35000 |
| .89 | 22.6 | 260 | 387 | 42400 |
| .98 | 24.9 | 310 | 462 | 58300 |
| 1.08 | 27.4 | 372 | 554 | 70000 |
| 1.19 | 30.2 | 442 | 659 | 85000 |
| 1.27 | 32.3 | 512 | 763 | 105000 |
| 1.41 | 35.8 | 612 | 912 | 130000 |
| 1.62 | 41.2 | 751 | 1,120 | 160000 |
| 1.78 | 45.2 | 905 | 1,350 | 200000 |
| 1.92 | 48.8 | 1,030 | 1,540 | 232000 |

Obviously, the above Table 1 indicates that PHILLYSTRAN® aramid fiber ropes are strong enough to support the weight of a person and accordingly, is suitable for use in the fall prevention system according to the invention.

The outer protective jacket 16 of PHILLYSTRAN® aramid fiber ropes is made of polyurethane specially developed to withstand harsh environments, and also to be tough enough to protect against chaffing and abrasion.

PHILLYSTRANS® aramid fiber ropes are currently inuse for overhead trolley power lines (no insulators required), structural guys, messenger lines, canopy awning lines, safety nets and lines.

An important advantage of aramid fiber is its excellent dielectric properties whereby aramid fiber ropes such as 14, including PHILLYSTRAN® aramid fiber ropes, when used in a fall prevention system installed onto a top mount antenna eliminate problems associated with steel cables such as:

electromagnetic interference (EMI);

radio frequency interference (RFI);

signal suppression;

directional irregularities; and zapping and white-noise arcing associated with ceramic insulators interference with television reception near broadcast sites.

Also, exposure to high power (megawatt) electric, magnetic and/or electromagnetic fields will not degrade the materials forming an aramid fiber rope such as the PHILLYSTRAN® aramid fiber rope.

Accordingly, the inventor has discovered that an aramid fiber rope such as the PHILLYSTRAN® aramid fiber rope used in the fall prevention system according to the invention will eliminate the drawbacks of the prior art (steel cables, nylon and polypropylene ropes) when the fall prevention system 10 is installed onto a top mounted antenna.

Referring back to FIG. 1 of the appended drawings, the aramid fiber rope 14 has an upper end anchored to the upper end of the top mount antenna 11 of the television broadcasting tower 12. The anchoring structure is detailed in FIG. 3.

A steel plate 17 is first secured to the top of the top mount antenna 11. In the case of the illustrated preferred embodiment, the steel plate 17 comprise a circular hole 19 to receive a bolt-and-nut assembly 18 existing on the upper end of the top mount antenna 11. Therefore, the steel plate 17 is fixedly secured to the upper end of the top mount antenna 11 by means of the bolt-and-nut assembly 18.

An eyelet bolt 190 has a threaded rod 20 and an eyelet 21. A nut 22 is first screwed onto the threaded rod 20 and a tubular stabilizer element 23 is then inserted onto the threaded rod 20 with a lock washer 27 interposed between the nut 22 and the stabilizer element 23. The free end of the threaded rod 20 is then passed through an oblong hole 26 in the plate 17, a lock washer 24 is inserted onto the threaded rod free end and, finally, a nut 25 is screwed and tightened onto the free end of the threaded rod 20. The oblong hole 26 in the steel plate 17 provides for lateral positional adjustment of the eyelet bolt 19 and tubular stabilizer element 23 to apply that stabilizer element 23 to the upper end of the top mount antenna 11, the stabilizer element 23 being designed to fit laterally onto the upper end of the top mount antenna 11 to thereby prevent any bending of the plate 17 caused by the weight of the safety rope 14 and any charge supported by this safety rope 14. This structure will fixedly secure the eyelet bolt 19 to the plate 17 while preventing any bending of the latter plate 17.

The upper end of the safety rope 14 is mounted onto a heart-shaped thimble 28 to form an eyelet 29. Two grip clips 30 and 31 are installed onto the two laterally adjacent sections of the safety rope 14 to hold that safety rope 14 onto the thimble 28. A removable cap 32, made of polyurethane, is removably mounted onto the free end of the safety rope 14.

Finally, a shackle 33 comprises a U-shaped portion inserted into the eyelet 29 of the thimble 28, and a bolt inserted into the eyelet 21 to fixedly fasten the upper end of the safety rope 14, equipped with the thimble 28 and the clips 30 and 31, to the eyelet bolt 19; the upper end of the safety rope 14 is then fixedly fastened to the upper end of the top mount antenna 11.

Referring back to FIG. 1, the safety rope 14 must be removably fastened to the top mount antenna 11 at certain intervals by rope stand-off brackets. These brackets will also prevent lateral movement of the rope 14 of too high an amplitude. Lateral movement of the safety rope 14 may be caused by bad weather conditions such as wind, rain, snow, etc. or by the fall of a person attached to this rope.

Figure 4A:
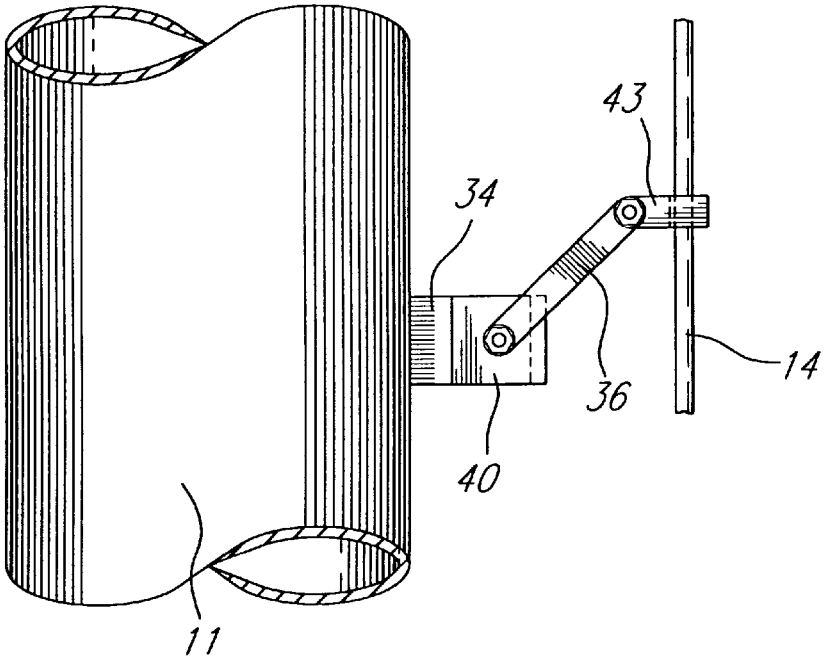
FIG. 4*a* is a partial, enlarged side elevational view of the fall prevention system of FIG. 1, showing an intermediate rope stand-off bracket of that system.
Figure 4B:
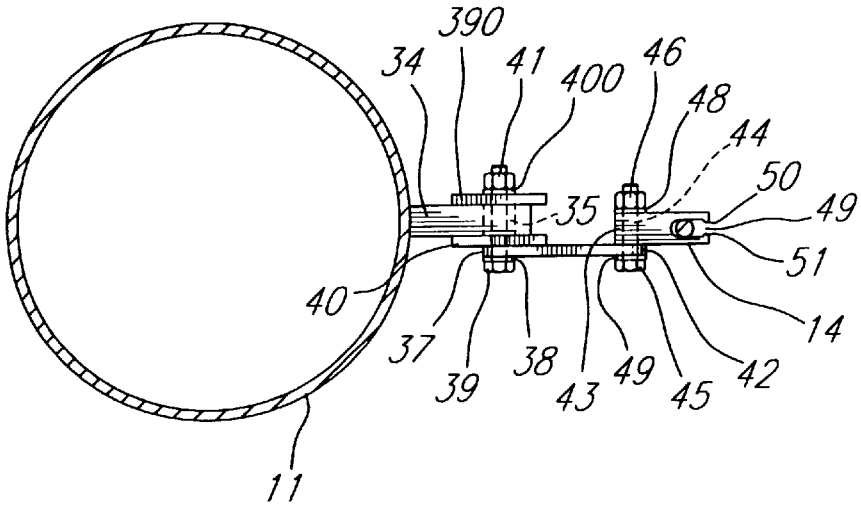
FIG. 4*b* is a top plan view of the intermediate rope stand-off bracket of FIG. 4*a;*

In the example illustrated in FIG. 1, two intermediate rope stand-off brackets 33 are provided for removably fastening the safety rope 14 to the top mount antenna 11. FIGS. 4*a* and 4*b* are side elevational and top plan views, respectively, of an intermediate rope stand-off bracket 33.

Referring to FIGS. 4*a* and 4*b,* a rope stand-off bracket 33 is mounted onto a vertically disposed steel plate 34 already provided onto the top mount antenna 11. As illustrated, steel plate 34 has an edge welded to the top mount antenna 11 and comprises a hole 35 therein.

Each rope stand-off bracket 33 comprises a steel flat bar 36 formed at a proximate end with a hole 37 having a diameter smaller than that of the hole 35. To install the flat bar 36, a lock washer 38 is first inserted onto a bolt 39 followed by the hole 37 of the proximate end of the steel flat bar 36. The central hole of a generally square steel plate 40 then receives the bolt 39 which is thereafter inserted into the hole 35. Finally a generally square plate 390 and a lock washer 400 are interposed between the plate 34 and a nut 41 screwed onto the threaded rod of the bolt 39. Tightening of the nut 41 completes the assembly of the flat metal bar 36 to the plate 34. As can be seen in FIG. 4*a,* the flat bar 36 is mounted at an acute angle with respect to the vertical.

The distal end of the steel flat bar 36 is also provided with a hole 42 to install a rope holding element 43 also provided with a hole 44 therein. A bolt 45 is inserted in both holes 42 and 44 and, then, a nut 46 is screwed onto the threaded rod of bolt 45, with a lock washer 49 interposed between the flat bar 36 and the head of the bolt 45 and a lock washer 48 interposed between the rope holding element 43 and the nut 46. Tightening of the nut 46 completes the installation of the rope holding element 43 to the distal end of the steel flat bar 36.

Referring to FIG. 4*b,* the rope holding element 43 includes a vertically extending groove 49 to receive the safety rope 14. Mutually confronting, vertically extending inward ridges 50 and 51 retain the safety rope 14 into the groove 49 but enable manual withdrawal of the safety rope 14 from the groove 49 to enable sliding of a freehand rope grab 52 (FIG. 6) at the level of the corresponding intermediate rope stand-off bracket 33. After the rope grab 52 has slid past the intermediate rope stand-off bracket 33, the safety rope 14 can be manually replaced into the groove 49.

As illustrated in FIG. 1 of the appended drawings, the aramid fiber rope 14 has a lower end anchored to the lower end of the top mount antenna 11.

Figure 5:
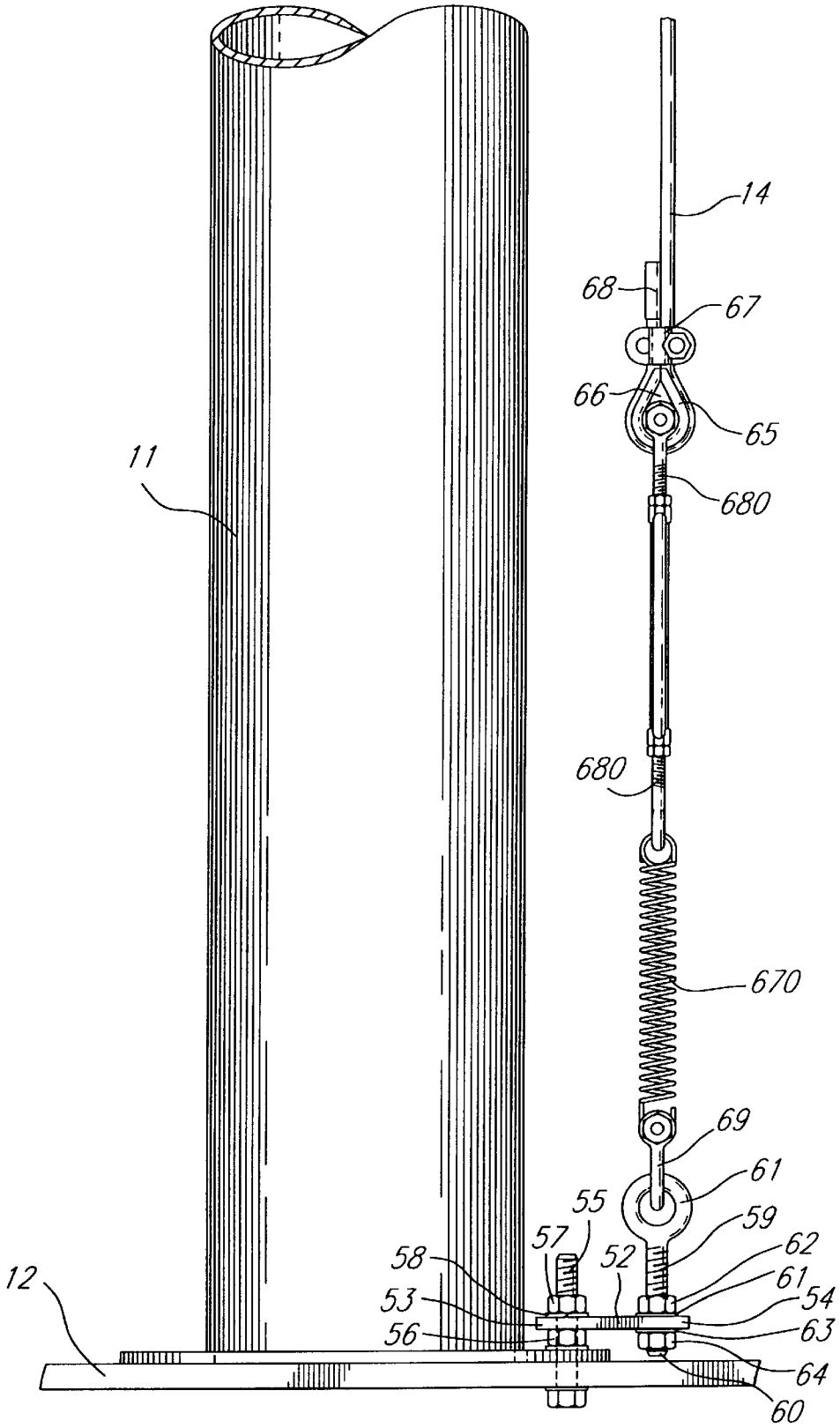
FIG. 5 is a partial, enlarged side elevational view of the fall prevention system of FIG. 1, showing a mechanical assembly for attaching the lower end of the safety rope to the lower section of the top mount antenna.

The corresponding anchor structure comprises, as illustrated in FIG. 5, a steel plate 52 having a circular hole 53 and an oblong hole 54. The circular hole 53 is inserted onto the free upper end of a bolt 55 already provided onto the tower 12, and the plate 52 is applied onto a nut 56 screwed onto the bolt 55. To secure the plate 52 to the tower 12, an additional nut 57 is screwed onto the free upper end of the bolt 55 with a lock washer 58 inserted between the nut 57 and the plate 52. Tightening of the nut 57 completes the installation of the plate 52 to the tower 12.

An eyelet bolt 59 has a threaded rod 60 and an eyelet 61. A nut 62 is first screwed onto the threaded rod 60 and the free end of the threaded rod 60 is inserted in the oblong hole 54, from the top of the plate 52, with a lock washer 61 interposed between the nut 62 and the plate 52. Finally, a lock washer 63 is inserted onto the threaded rod free end and a nut 64 is screwed and tightened onto the free end of the threaded rod 20 to complete the assembly. The oblong hole 54 in the steel plate 52 provides for lateral positional adjustment of the eyelet bolt 59 about the top mount antenna 11.

The lower end of the aramid fiber rope 14 is mounted onto a heart-shaped thimble 65 to form an eyelet 66. A grip clip 67 is installed onto the two laterally adjacent sections of the safety rope 14 to hold that safety rope 14 onto the thimble 65. A removable cap 68, made of polyurethane, is removably mounted onto the free end of the safety rope 14.

The eyelets 61 and 66 are interconnected by a series arrangement including a stainless steel helicoidal spring 670 and a spring tension adjuster 680. The helicoidal spring 670 has a lower end connected to the eyelet 61 through a shackle 69, and an upper end connected to the eyelet 66 through the spring tension adjuster 680. As well known to those of ordinary skill in the art, a spring tension adjuster such as 680 can be extended or retracted to adjust the tension in the spring 670 and, accordingly, the tension in the safety rope 14. As spring tension adjusters are well known to those of ordinary skill in the art, they will not be further described in the present disclosure.

Figure 6:
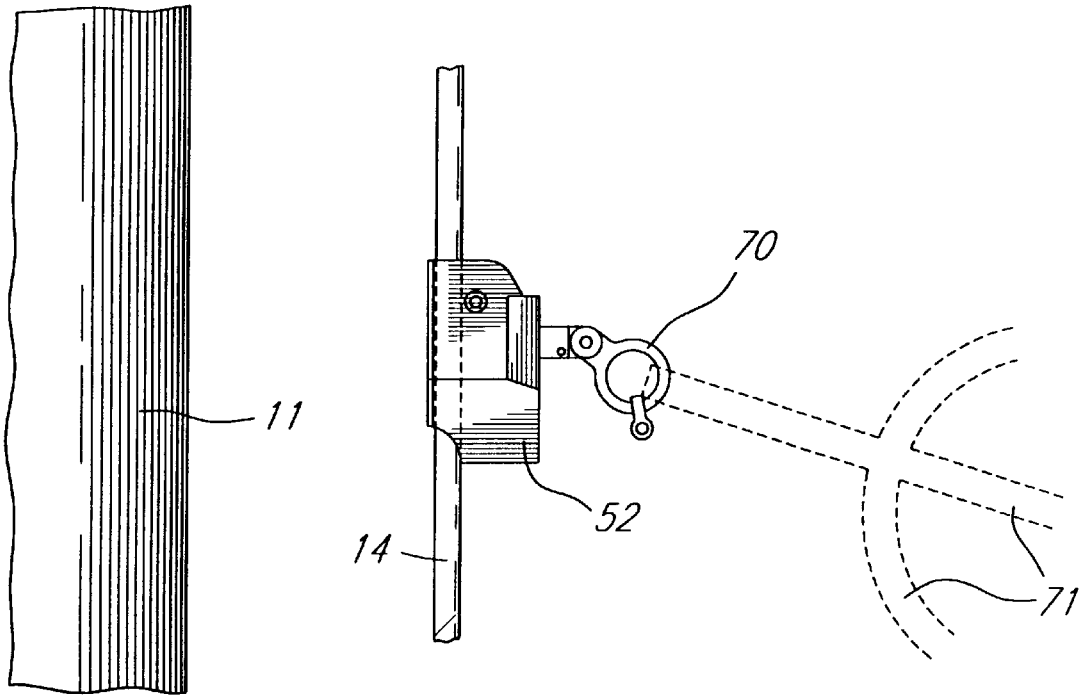
FIG. 6 is a partial, enlarged side elevational view of the fall prevention system of FIG. 1, showing an individual safety harness connected to the safety rope through a free-hand rope grab.

In operation, the fall prevention device 10 comprises, as illustrated in FIG. 6 of the appended drawings, a freehand rope grab 52 capable of sliding upwardly and downwardly onto the aramid fiber rope 14. The freehand rope grab 52 comprises an eyelet 70 to which an individual safety harness 71 (shown in part only) is attached. Upon falling of the person wearing the harness 71, the freehand rope grab 52 locks onto the safety rope 14 whereby the safety rope 14 will support the person through the grab 52 and the harness 71 to prevent that person to make a fatal fall.

In the illustrated example, a person wearing the harness 71 climbs the top mount antenna 11 by means of, for example, threaded step pins (not shown) installed into threaded holes (not shown) of the top mount antenna 11 as the person climbs the antenna. At the level of each intermediate stand-off bracket 33, the safety rope 14 is withdrawn from the groove 49 to allow the freehand rope grab 52 to slide upwardly past that grab 52; the safety rope 14 is then replaced into the groove 49.

As the person move down, he removes the threaded step pins (not shown). Again, at the level of each intermediate rope stand-off bracket 33, the safety rope 14 is withdrawn from the groove 49 to allow the freehand rope grab 52 to slide downwardly past that grab 52; the safety rope 14 is then replaced into the groove 49.

If the person climbing or moving down the top mount antenna 11 falls for any reason, the freehand rope grab 52 will lock onto the safety rope 14 whereby the safety rope 40 will support the person through the grab 52 and the harness 71 to prevent that person to make a fatal fall.

As indicated in the foregoing description, persons, more specifically workers must frequently climb top mount antennae for maintenance and any other purposes. The fall prevention system according to the invention will render this operation safe and will obviously save lives.

It should be pointed out here that the fall prevention system according to the present invention is not limited to an application to top mount antennae; it is within the scope of the present invention to apply the fall prevention system to any type of tower and pylon such as bridge tower, supporting tower, cable tower, pylon mast, lattice tower, relay tower, etc.

Although the present invention has been described hereinabove with reference to a preferred embodiment thereof, this embodiment can be modified at will, within the scope of the appended claims, without departing from the spirit and nature of the subject invention.

What is claimed is:

1. In combination a generally vertical radio-frequency wave radiating antenna mounted on a tower and a permanent fall prevention system installed on said vertical radio-frequency wave radiating antenna, said permanent fall prevention system comprising a safety rope extending between an upper portion of said vertical radio-frequency wave radiating antenna and a lower portion thereof, said safety rope having:

first and second ends;

an aramid fiber core; and a protective jacket made of a radio-frequency wave resistant plastic material and extruded over the aramid fiber core for imperviously covering said aramid fiber core; and mechanical means installing the safety rope generally vertically along said generally vertical antenna, the mechanical means comprising first means attaching said first end of the safety rope to said upper portion of said generally vertical radio-frequency wave radiating antenna, and second means attaching said second end of the safety rope to said lower portion of said generally vertical radio-frequency wave radiating antenna.

2. The combination as recited in claim 1, in which the aramid fiber core is a polyurethane resin impregnated aramid fiber core and the protective jacket is a jacket of polyurethane.

3. The combination as recited in claim 1, in which the second attaching means comprises spring means for tensioning the safety rope, and in which the mechanical means further comprise at least one rope stand-off bracket intermediate the first and second attaching means, said at least one rope stand-off bracket comprising means for removably grasping the safety rope.

* * * * *